United States Patent [19]

Komaki et al.

[11] 4,234,944

[45] Nov. 18, 1980

[54] ALARM ELECTRONIC TIMEPIECE

[75] Inventors: Shojiro Komaki; Noboru Kaneko, both of Tokyo, Japan

[73] Assignee: Kabushiki Kaisha Daini Seikosha, Tokyo, Japan

[21] Appl. No.: 966,271

[22] Filed: Dec. 4, 1978

[30] Foreign Application Priority Data

Dec. 8, 1977 [JP] Japan ..... 52-147519

[51] Int. Cl.[3] ..... G04C 21/00

[52] U.S. Cl. ..... 368/72; 368/155; 368/223; 368/251; 368/245

[58] Field of Search ..... 98/21.12, 57.5, 38, 98/152 B, 19 R

[56] References Cited

U.S. PATENT DOCUMENTS

| | | | |
|---|---|---|---|
| 3,727,395 | 4/1973 | Baylor | 58/21.12 |
| 3,946,549 | 3/1976 | Cake | 58/38 R |

*Primary Examiner*—Ulysses Weldon

*Attorney, Agent, or Firm*—Robert E. Burns; Emmanuel J. Lobato; Bruce L. Adams

[57] ABSTRACT

An alarm electronic timepiece comprises an oscillating circuit for generating a high frequency reference signal which is frequency divided by a frequency dividing circuit into a lower frequency time signal. A display device displays information indicative of the present time in accordance with the time signal. An alarm counter is preset with the desired alarm time and a coincidence detecting circuit detects coincidence between the present time and the preset alarm time and accordingly provides an output signal which is fed to a buzzer for generating an alarm sound. Circuitry is provided for sounding the alarm in advance of the preset alarm time and at a low sound volume which gradually increases with the passage of time, such circuitry including a subtraction circuit connected between the alarm counter and the coincidence detecting circuit, a ring counter connected to receive the output signal from the coincidence detecting circuit, and a modulation circuit connected to the ring counter for modulating the signal applied to the buzzer.

4 Claims, 5 Drawing Figures

ALARM ELECTRONIC TIMEPIECE

BACKGROUND OF THE INVENTION

The present invention relates to an alarm electronic timepiece, and more particularly, to an alarm electronic timepiece which generates an alarm sound whose sound volume gradually increases before the alarm setting time to thereby awaken a person pleasantly.

Conventionally, the alarm sound of an alarm electronic timepiece starts to generate at the alarm setting time with a constant sound volume and continues for a constant period of time. In the conventional method, however, it is difficult to awaken a person at the precise setting time since it takes some time to actually awaken and also to awaken suddenly by a noisy alarm sound is frequently accompanied by an unpleasant feeling.

It is an object of the present invention to provide an alarm electronic timepiece for awakening a person gradually and pleasantly from a sleep by generating an alarm sound which begins before the alarm setting time and which has a gradually increasing sound volume.

DETAILED DESCRIPTION OF PREFERRED EMBODIMENT

Figure 1:
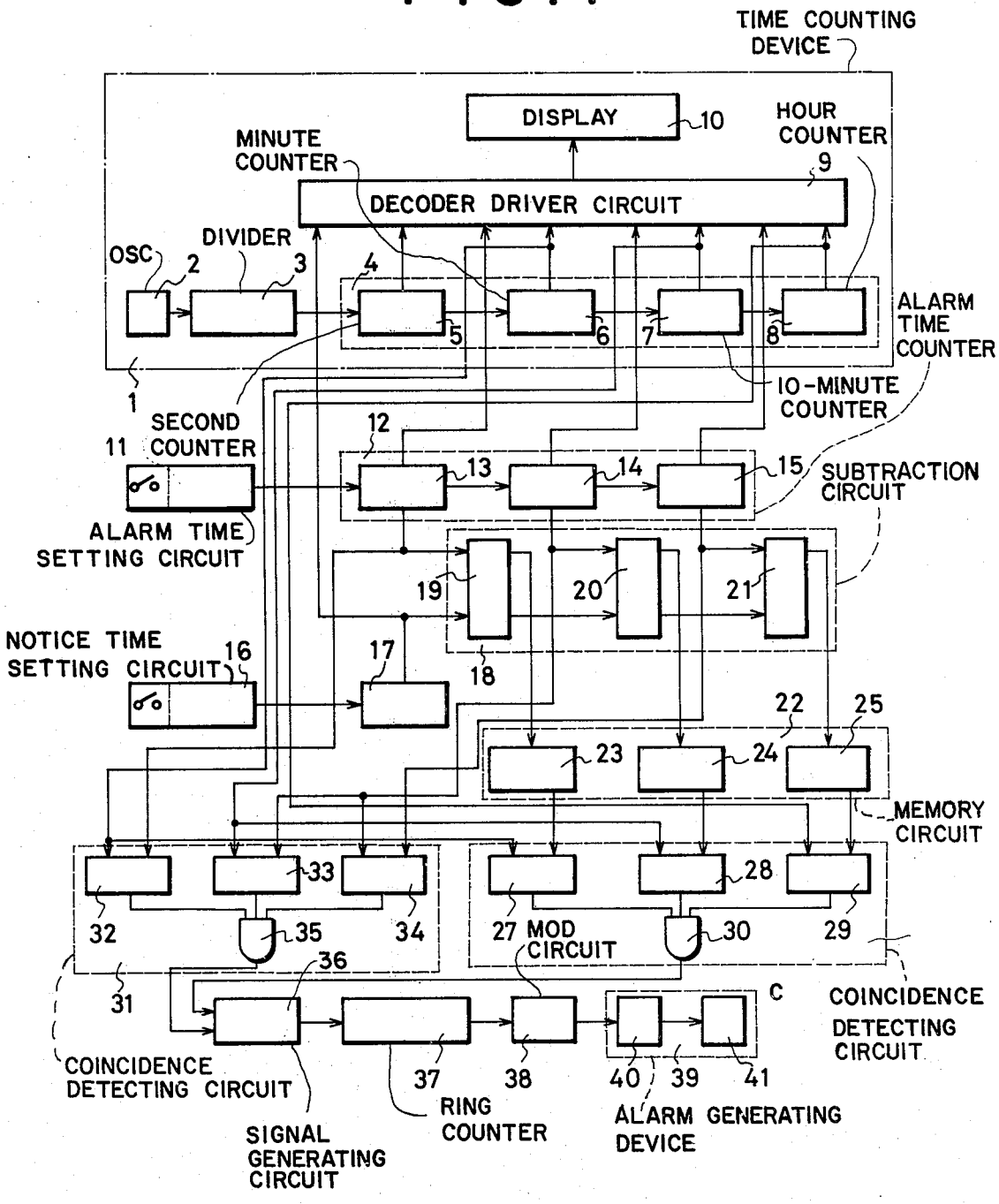
FIG. 1 is a block diagram showing one embodiment of alarm electronic timepiece according to the present invention.

FIG. 1 shows an embodiment of an alarm generating device of an alarm electronic timepiece according to the present invention, in which numeral 1 is a time counting device which counts time. The time counting device 1 comprises an oscillation circuit 2 which generates a fixed high frequency reference signal using a quartz resonator or the like. The high frequency reference signal of the oscillating circuit 2 is divided by a frequency dividing circuit 3 to produce a lower frequency time signal which is used in the conventional manner for keeping time. The output from the frequency dividing circuit 3 is fed to a counter circuit 4. The counter circuit 4 is composed of a 60-step second counter 5 which counts "second", a 10-step 1 minute figure counter 6 which counts "minute", a 6-step 10 minute figure counter 7 and a 12-step hour counter 8 which counts "hour". The second counter 5 generates a pulse signal every one minute by receiving the output from the frequency dividing circuit 2, and the 1 minute figure counter 6 generates a pulse signal every 10 minutes by receiving the output from the second counter 5 and feeds the output thereof to the 10 minutes figure counter 7. The 10 minute figure counter 7 generates a pulse signal every one hour and feeds the output thereof to the hour counter 8.

The counted contents of the second counter 5, the 1 minute figure counter 6, the 10 minute figure counter 7 and the hour counter 8 are respectively applied to a decoder driver circuit 9. The decoder driver circuit 9 converts each of the counted contents of second, minute and hour of the counter circuit 4 into required codes and feeds the drive signal to a display panel 10 which displays the codes digitally in the form of time information.

Numeral 11 is an alarm time setting circuit for setting the desired alarm time that the alarm generates. The alarm time setting circuit 11 feeds the desired alarm generating time to an alarm time counter 12 by a manual switch provided in the alarm time setting circuit 11. The alarm time counter 12 is composed of a 10-step 1 minute figure counter 13 which memorizes "minute", a 6-step 10 minute figure counter 14, and a 120-step hour counter 15 which memorizes "hour". Numeral 16 is a notice time setting circuit for setting the desired notice time. The notice time is set and memorized in a 10-step notice time memory circuit 17 by a manual switch provided in the notice time setting circuit 16. The time which is set in the notice time memory circuit 17 is subtracted from the alarm generating time memorized in the alarm time counter 12 by way of a subtraction circuit 18 and the computed output is fed to a memory circuit 22 which memorizes the notice time. The subtraction circuit 18 consists of a subtraction circuit 19 which subtracts the notice time of the notice time memory circuit 17, a subtraction circuit 20 which subtracts "1" from the setting time of the 10 minute figure counter 14 when a borrow signal is generated from the subtraction circuit 19, and a subtraction circuit 21 which subtracts "1" from the setting time of the hour counter 15 when a borrow signal is generated from the subtraction circuit 20. The memory circuit 22 is composed of a register 23 which receives and memorizes the computing output of the subtraction circuit 19, a register 24 which receives and memorizes the computing output of the computing circuit 20 and a register 25 which receives and memorizes the computing output of the computing circuit 21. The memorized content of the memory circuit 22 and that of the counter circuit 4 are respectively fed to a coincidence detecting circuit 26. The coincidence detecting circuit 26 is composed of a coincidence detecting circuit 27 which receives the count content of the 1 minute figure counter 6 and the memory content of the register 23, a coincidence circuit 28 which receives the count content of the 10 minute figure counter 7 and the memory content of the register 24, a coincidence circuit 29 which receives the count content of the hour counter 8 and the memory content of the register 25, and an AND gate 30 which receives the outputs from the coincidence circuits 27, 28 and 29. Numeral 31 is a coincidence detecting circuit which receives the count content of the counter circuit 4 and the memory content of the alarm time counter circuit 12. A coincidence detecting circuit 31, of the same composition as the coincidence detecting circuit 26, is composed of a coincidence circuit 32 which receives the count content of the 1 minute figure counter 6 and the memory content of the 1 minute figure counter 13, a coincidence circuit 33 which receives the count content of the 10 minute figure counter 7 and the memory content of the 10 minutes figure counter 14, a coincidence circuit 34 which receives the count content of the hour counter 8 and the memory content of the hour counter 15, and an AND gate 35 which receives the outputs from the coincidence circuits 32, 33 and 34.

The outputs from the coincidence detecting circuits 26 and 31 are fed to a signal generating circuit 36. The signal generating circuit 36 generates the required pulse signal to a ring counter 37 in accordance with the output signal from the coincidence detecting circuits 26 and 31. The ring counter 37, which receives the pulse signal, feeds the count content thereof to a modulation circuit 38. The modulation circuit 38 varies the signal generated from an alarm generating device 39 by the count content of the ring counter 37 and accordingly varies the sound volume, which is the object of the present invention. An alarm generating device 39, provided with a driving circuit 40 and a buzzer 41, receives the output signal from the modulation circuit 38 to thereby drive the buzzer 41 by the driving circuit 40.

A general composition of an alarm electronic timepiece according to the present invention has been illustrated so far.

Reference will now be made to the operation of the alarm electronic timepiece according to the present invention, in which the description of the time counting device which is of known construction and not directly related to the present invention will be eliminated.

An alarm generating time such as "7:00" is set in the alarm time counter 12 by the alarm time setting circuit 11. Then the notice time such as "5 minutes before" is set in the notice time memory circuit 17 by the notice setting circuit 16. And then "0000" is memorized in the 1 minute figure counter 13 of the alarm time counter 12, "000" is memorized in the 10 minute figure counter 14 and "0111" is memorized in the hour counter 15. "0101" is memorized in the notice time memory circuit 16.

By the subtraction circuit 18, each of the above mentioned memory contents are fed to the memory circuit 22 as "6:55" to be memorized. Namely, "0101", "101" and "0110" are memorized in each of the registers 23, 24 and 25. The composition of the subtraction circuit 18 is as shown in FIG. 2. The subtraction circuits will be illustrated in conjunction with FIG. 2.

With respect to a subtraction of the 1 minute figure counter 13, the memory content of the notice time memory circuit 17 is converted into a complement of 10 by a 10 complement circuit 51. The signal converted into a complement of 10 by the 10 complement circuit 51 and the memory content of the 1 minute figure counter 13 are added by an addition circuit comprised of a semi adder (half adder) 52 and total adders (full adders) 53, 54 and 55.

By a correction circuit comprised of a semi adder 56, a total adder 57, an exclusive OR gate 58, AND gates 59 and 60 and an OR gate 61, an addition output is fed to the register 23 without correction when the addition output of the adders 52 to 55 is less than "9" and an addition output added to "6" is fed to the register 23 when the addition output is more than "10". By the subtraction circuit 19 mentioned so far, the memory content subtracting the memory content of the notice time memory circuit 17 from that of the 1 minute figure counter 13 is fed to the register 23. At this time the output signal of an inverter 61' is "1" when the memory content of 1 minute figure counter 13 is smaller than that of the notice time memory circuit 17. Namely, the output signal of the inverter 61' becomes a borrow signal to the next minute and applies the borrow signal to the subtraction circuit 20. Now the memory content of the 1 minute figure counter 13 is "0" and the memory content of the notice time memory circuit is "5" is memorized in the register 23 by the subtraction circuit 19 and since "0" is smaller than "5", a borrow signal "1" is fed from the inverter 61'.

Figure 2A:
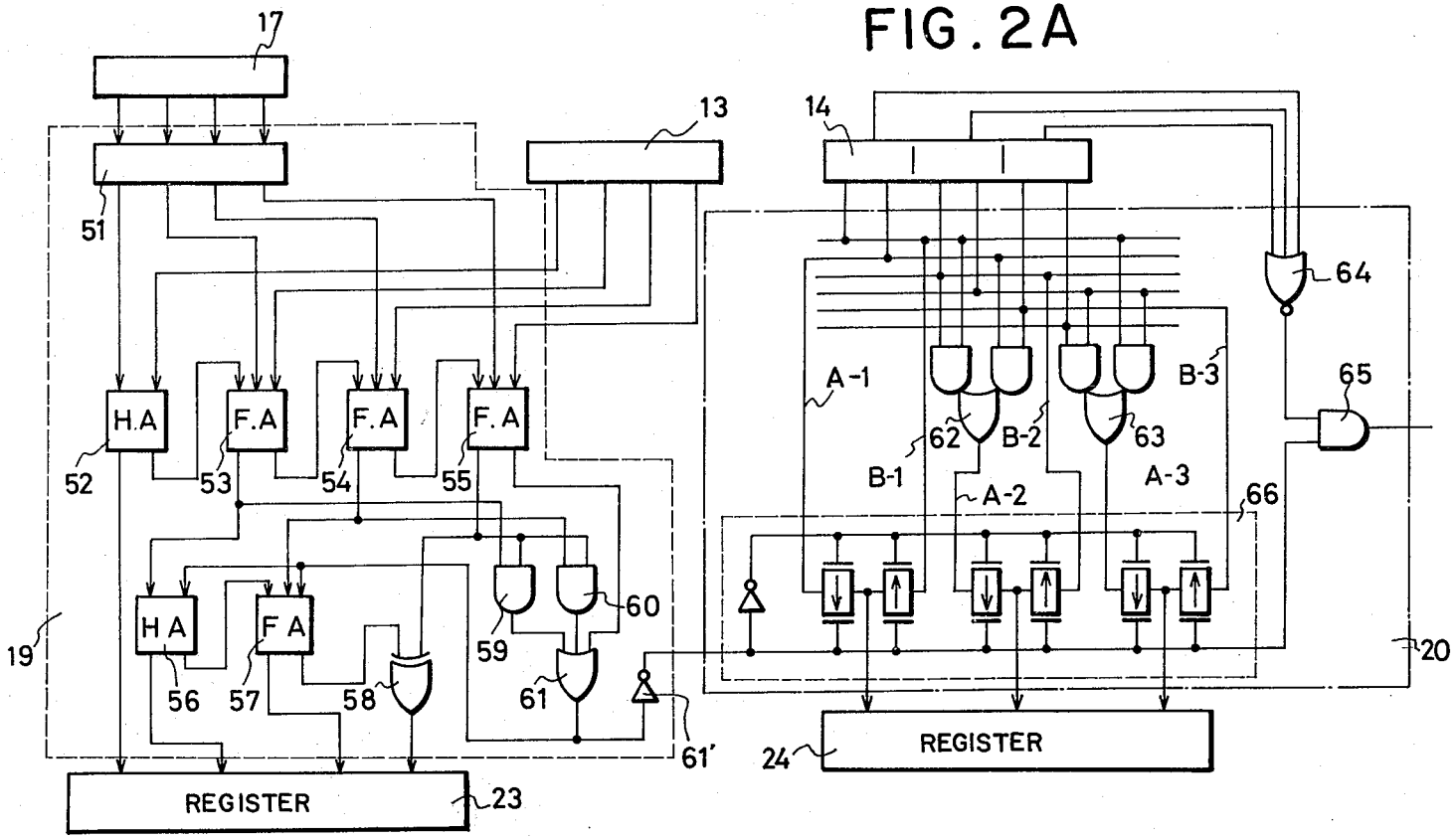
FIGS. 2A and 2B are detailed circuit diagrams of circuitry shown in FIG. 1.

The borrow signal is fed to a change-over circuit 66 of the subtraction circuit as a change-over control signal thereof. The circuit composition of the subtraction circuit 20 is as shown in FIG. 2A. In the drawing, lines A-1, A-2 and A-3 designate line signals having the content subtracting "1" from the memory content of the 10 minute figure counter 14, and lines B-1, B-2 and B-3 designate line signals having the same memory content as the 10 minute figure counter 14. Each of the line signals A-1 to A-3 and B-1 to B-3 are respectively fed to the change-over circuit 66 as shown in the drawing. The change-over circuit 66 feeds line signals B-1, B-2 and B-3 to the register 24 when the output borrow signal of the inverter 61' of the subtraction circuit 19 is "0". Namely, the memory content of the 10 minute figure counter 14 is fed to the register 24 as it is to be memorized. When the borrow signal is "1", line signals A-1, A-2 and A-3 are fed to the register 24. Namely, a number subtracting "1" from the memory content of the 10 minute figure counter 14 is fed to the register 24 to be memorized.

When the memory content of the 10 minute figure counter 14 is "0", i.e. when each of the bits are "000", an output from a NOR gate 64 to which each of the bit signals are fed becomes "1". If a borrow signal "1" is generated from the subtraction circuit 19, the 10 figure should be subtracted borrowing "1" from the next hour figure, and thereby the subtraction circuit 20 should generate the borrow signal "1" to the next figure. A circuit for generating the borrow signal "1" consists of the NOR gate 64 and the AND gate 65 which receives the output from the NOR gate 64 and the borrow signal produced from the subtraction circuit 19 as an input signal. Now "0" is memorized in the 10 minute figure counter 14 and the subtraction circuit 19 feeds the borrow signal "1" to the subtraction circuit 20. Then "5" subtracting "1" from the memory content of the 10 minute figure counter 14 is fed to the register 24, and the output from the AND gate 65 becomes "1" and the borrow signal is fed to the next figure hour counter 15.

Figure 2B:
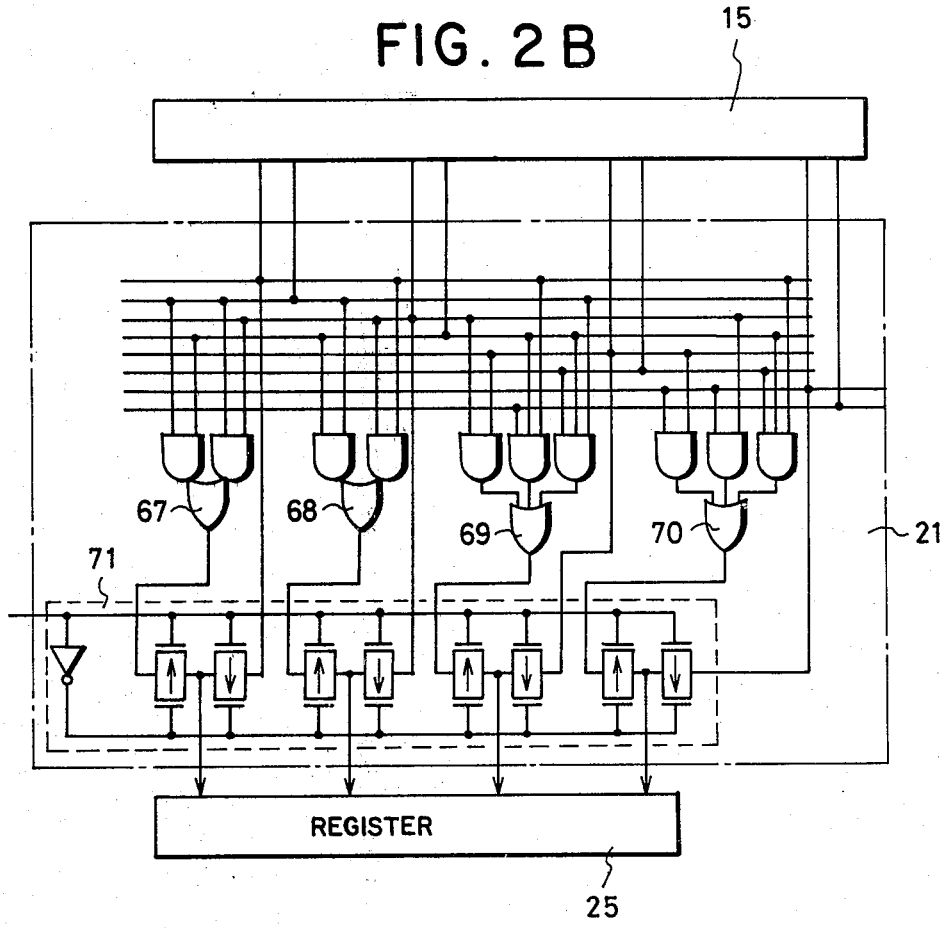

The subtraction circuit 21 of the hour figure as is shown in FIG. 2B and is of the same composition as the subtraction circuit 20, and the borrow signal of the subtraction circuit 20 is fed to a change-over circuit 71 as a control signal. The borrow signal generated from the subtraction circuit 21 is "1" and at this time the output subtracting "1" from the memory content of the hour counter 15, that is to say, "6" subtracting "1" from the memory content "7" of the hour counter 15 is fed to the register 25.

As mentioned above, "6:55" is memorized in each of the registers of the memory circuit 22. "5" on the 1 minute figure is memorized in the register 23, "5" on the 10 minute figure is memorized in the register 24 and "6" on the hour figure is memorized in the register 25.

When the counter circuit 4 of the time counting device 1 counts "6:55", the coincidence circuits 27, 28 and 29 each generates the coincidence output "1" and the output generated from the AND gate 30 becomes "1".

Reference will now be made to the modulation circuit 38 and associated circuitry. The driving circuit 40 generates buzzer driving signal to drive the buzzer 41 and the sound volume generated from the buzzer 41 can be changed according to a change of the duty cycle of the buzzer driving signal when the voltage value of the buzzer driving signal is constant.

Figure 3:
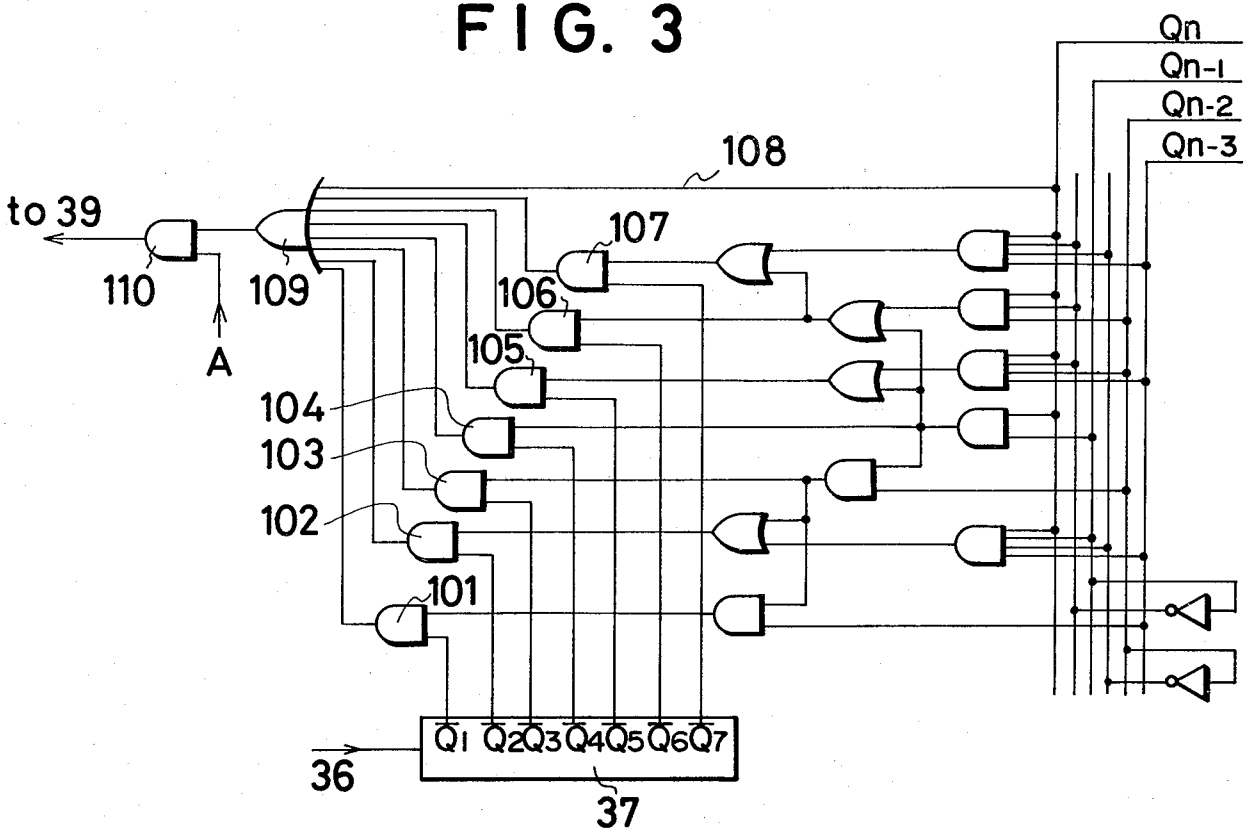
FIG. 3 is a detailed circuit diagram of a modulation circuit.
Figure 4:
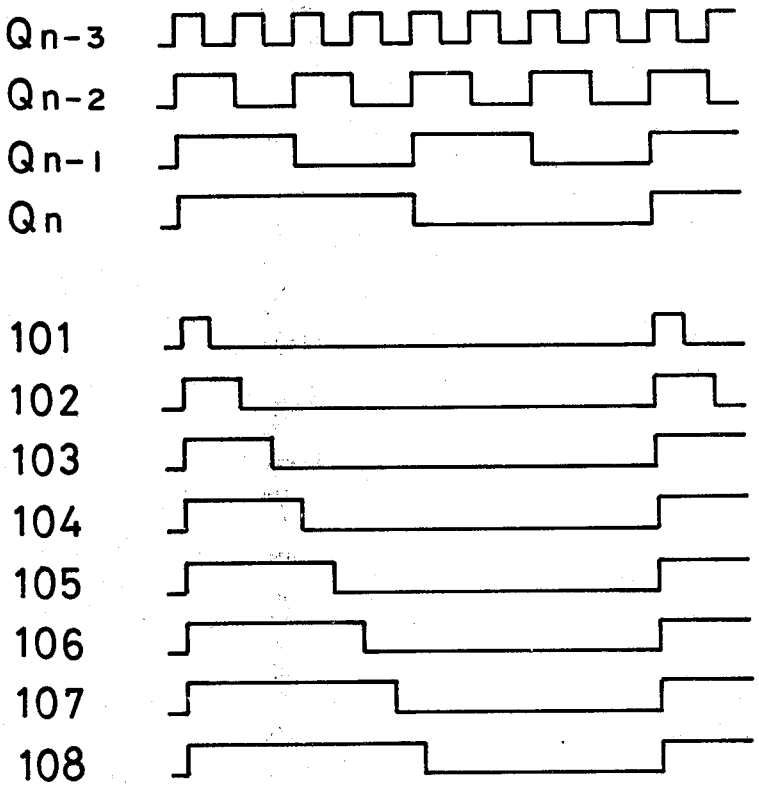
FIG. 4 is a time chart showing the output signals of the modulation circuit of FIG. 3.

Taking advantage of the above, a signal as shown in FIG. 4 is fed to the driving circuit 40. The signals shown in FIG. 4 are realized by the circuitry shown in FIG. 3.

In FIG. 3, the signal shown in FIG. 4 is generated by the $\overline{Q}$ output from the ring counter 37. The ring counter 37 consists of 7 flip-flop stages. The signal generating circuit 36 generates clock signals every two minutes which are fed to the ring counter 37 after the output signal from the coincidence circuit 26 becomes "1".

A signal "A" in FIG. 3 comprises a control signal of an AND gate 110 whose output is fed to the buzzer 41 to control the buzzing period. In operation, the AND gates 101 to 107 are closed in turn by the ring counter 37 and the signals 101 to 108 shown in FIG. 4 are generated in turn from the AND gate 110.

Accordingly, the sound volume generated from the buzzer 41 becomes gradually louder.

As illustrated so far, according to the present invention, an alarm electronic timepiece is provided which can awaken a person pleasantly by gradually increasing the sound volume of the alarm before the alarm setting time.

It is to be noted that the present invention is not restricted to the disclosed embodiment and it is possible to change the interval of the alarm sound and the sound volume according to the user's preference.

We claim:

1. In an alarm electronic timepiece comprising an oscillating circuit for generating a high frequency reference signal, a frequency dividing circuit for dividing the reference signal into a low frequency time signal, a display device for displaying the present time in accordance with the time signal, an alarm counter for presetting a desired alarm time, a coincidence detecting circuit for detecting coincidence between a signal representative of the preset alarm time and a signal representative of present time and for generating an output signal when coincidence is detected, and a buzzer for generating an alarm sound in response to the output signal, the improvement comprising: means for generating the alarm sound at a time before the preset alarm time and at a sound volume which varies with the passage of time, said means including a subtraction circuit connected between said alarm counter and said coincidence detecting circuit, a ring counter connected to receive the output signal from said coincidence detecting circuit, and a modulation circuit connected to said ring counter for modulating the signal applied to said buzzer.

2. An alarm electronic timepiece according to claim 1; wherein said means further includes means comprising a notice time setting circuit and a notice time memory circuit for setting the time before said preset alarm time at which said buzzer begins generating the alarm sound.

3. An alarm electronic timepiece according to claim 1; wherein said modulation circuit includes means coacting with said ring counter for varying the duty cycle of the signal applied to said buzzer to thereby vary the sound volume of the buzzer alarm sound.

4. An alarm electronic timepiece according to claim 1; further including a memory circuit connected between said subtraction circuit and said coincidence detecting circuit.

* * * * *